US012044505B2

(12) United States Patent
Lee et al.

(10) Patent No.: US 12,044,505 B2
(45) Date of Patent: Jul. 23, 2024

(54) FOLDABLE SIGHT FOR FIREARMS

(71) Applicant: Strike IP, LLC, Las Vegas, NV (US)

(72) Inventors: Shanyao Lee, Las Vegas, NV (US); Chien-Yuan Cheng, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 0 days.

(21) Appl. No.: 18/130,962

(22) Filed: Apr. 5, 2023

(65) Prior Publication Data

US 2023/0349668 A1 Nov. 2, 2023

Related U.S. Application Data

(60) Provisional application No. 63/335,330, filed on Apr. 27, 2022.

(51) Int. Cl.
*F41G 1/16* (2006.01)
*F41G 1/033* (2006.01)

(52) U.S. Cl.
CPC ..... *F41G 1/16* (2013.01); *F41G 1/033* (2013.01)

(58) Field of Classification Search
CPC ..... F41G 1/16; F41G 1/17; F41G 1/033
USPC ..... 42/111, 124, 125, 138, 148, 140, 147, 42/127
See application file for complete search history.

(56) References Cited

U.S. PATENT DOCUMENTS 10,222,179 B2 * 3/2019 Smith ..... F41G 1/17
2016/0209166 A1 * 7/2016 Larson, Jr. ..... F41A 35/06

* cited by examiner

*Primary Examiner* — Reginald S Tillman, Jr.
(74) *Attorney, Agent, or Firm* — Han IP PLLC; Andy M. Han

(57) ABSTRACT

A foldable sight implementable on a firearm includes a base, a hinge and a sight body. The base is configured to be mounted on a portion of the firearm. The sight body is pivotably attached to the base by the hinge and contains a position holding device therein. The position holding device is configured to hold the sight body at either a first position or a second position responsive to the sight body being rotated from one of the first and second positions to another of the first and second positions.

8 Claims, 5 Drawing Sheets

FOLDABLE SIGHT FOR FIREARMS

CROSS REFERENCE TO RELATED PATENT APPLICATION(S)

The present disclosure claims the priority benefit of U.S. Provisional Patent Application No. 63/335,330, filed 27 Apr. 2022, the content of which being herein incorporated by reference in its entirety.

TECHNICAL FIELD

The present disclosure is generally related to firearms and, more particularly, to a foldable sight for firearms.

BACKGROUND

Unless otherwise indicated herein, approaches described in this section are not prior art to the claims listed below and are not admitted as prior art by inclusion in this section.

A firearm sight, also known as a gunsight or sight, is a device that aids in aiming a firearm and can come in different forms. Firearm sights can come in different forms including, for example, iron sights (e.g., on a pistol) as well as front and rear sights on rifles and carbines. A new trend in the form of firearm sights is foldable sight, which can be in either an open (up) or closed (down) position. When a foldable sight is not in use by a user (e.g., such as when the user is using an optics scope), the user can fold down the foldable sight to its closed position to prevent obstruction of the user's view of the optics scope. When in use, the user can flip the foldable sight up to its open position for aiming at a target.

Foldable sights are generally comprised of a number of components, including: a base, a rotating sight body, a hinge and, optionally, an adjustable aiming gear. When the user rotates the sight body, a detent (e.g., ball) with a spring will secure the sight body at one of several predefined positions. This detent and spring are typically located inside the base. However, this design does not allow sufficient space for a longer (stronger) spring due to the limited size of the base itself. As such, with a relatively short length, the spring might not exert enough force on the detent to positively secure the rotating sight body at a predefined position. While enlarging the base to accommodate a larger spring could potentially resolve this issue, such design could result in a larger-than-desirable size and a higher-than-desirable profile in terms of the overall form factor of the resultant foldable sight. Therefore, there is a need for a solution of a foldable sight with sufficient space to accommodate a stronger and longer spring and with a small base size and a low profile.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a foldable sight with sufficient space to accommodate a stronger and longer spring and with a small base size and a low profile. It is believed that a foldable sight under various proposed schemes of the present disclosure may address or otherwise alleviate the aforementioned issues.

In one aspect, a foldable sight implementable on a plurality of firearms (e.g., AR-style or AK-style rifles, carbines, pistols or shotguns) may include a base, a hinge and a sight body. The base may be configured to be mounted on a portion of the firearm. The sight body may be pivotably attached to the base by the hinge and may contain a position holding device therein. The position holding device may be configured to hold the sight body at either a first position or a second position responsive to the sight body being rotated from one of the first and second positions to another of the first and second positions.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
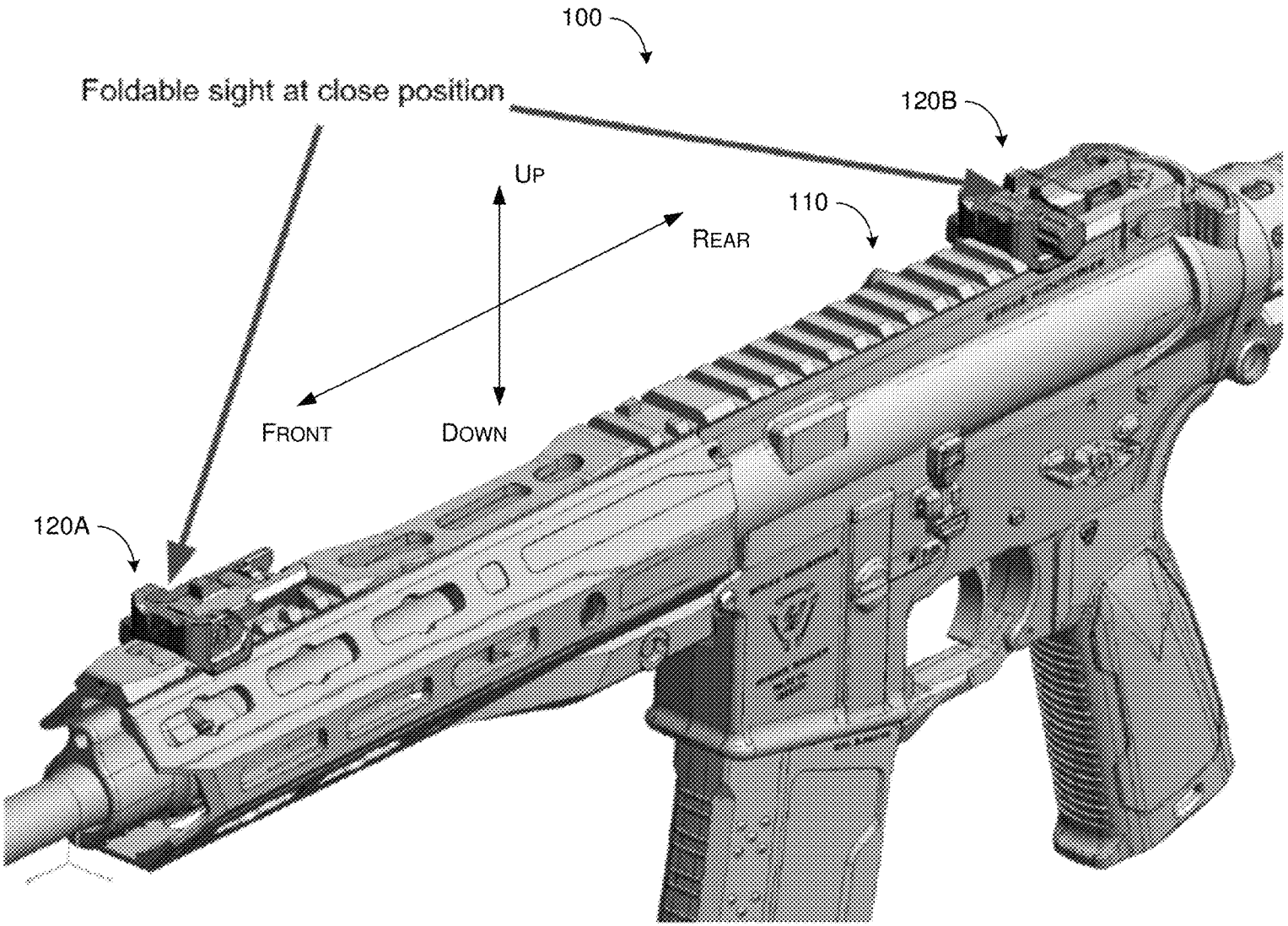
FIG. 1 is a diagram of an example implementation under a proposed scheme in accordance with the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 5 regarding a foldable sight for firearms under various proposed schemes in accordance with the present disclosure for a firearm. In some implementations, the firearm may be a pistol, such as a semiautomatic pistol. In other implementations, the firearm may be an AR-style firearm or an AK-style firearm, which may be a rifle, carbine, pistol or shotgun.

Figure 2:
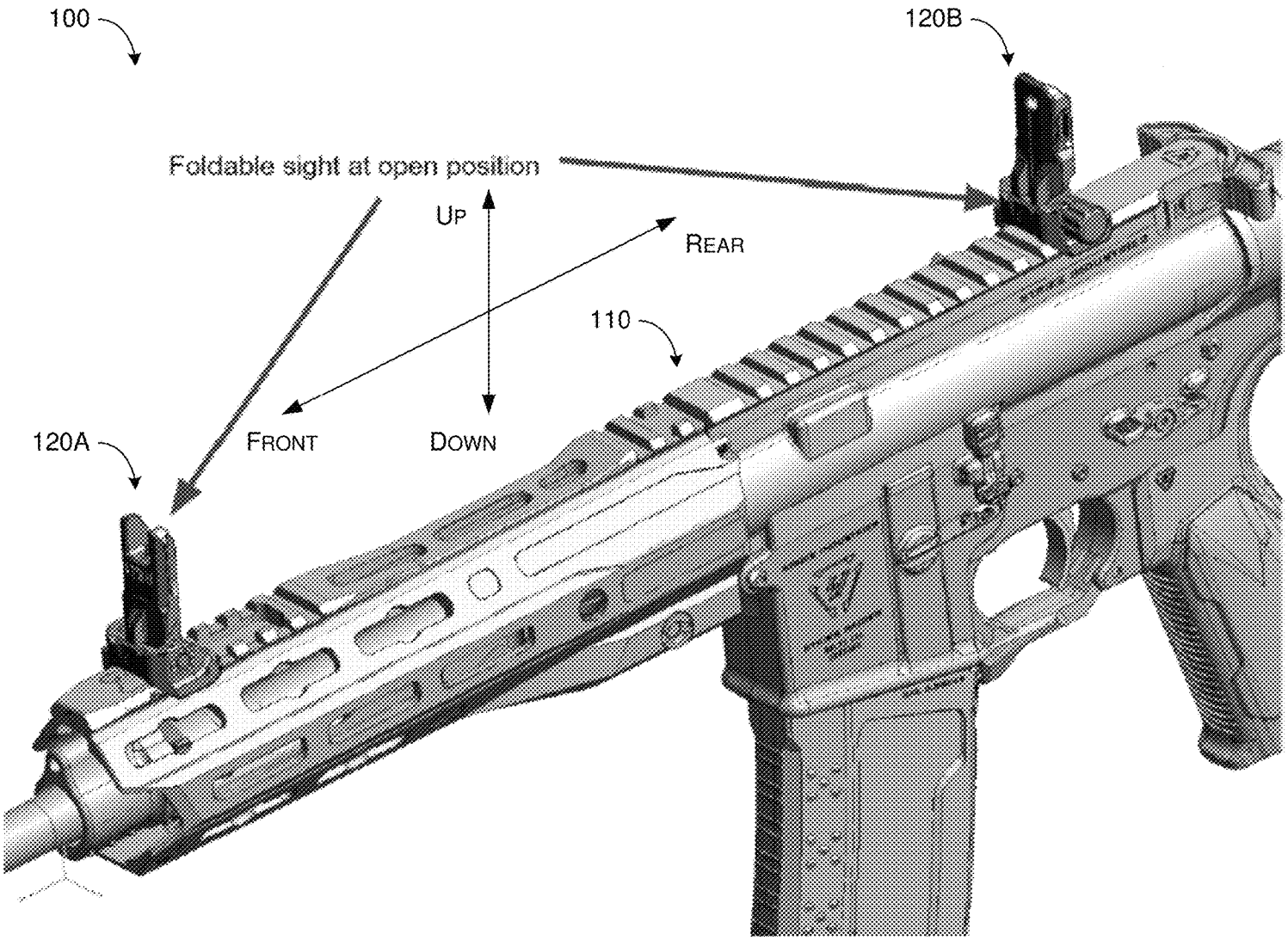
FIG. 2 is a diagram of an example implementation under a proposed scheme in accordance with the present disclosure.

Each of FIG. 1 and FIG. 2 illustrates an example implementation under a proposed scheme in accordance with the present disclosure. Referring to FIG. 1 and FIG. 2, an apparatus 100 may include a firearm 110 and one or more foldable sights under various proposed schemes in accordance with the present disclosure, such as front foldable sight 120A and rear foldable sight 120B. In FIG. 1, each of front foldable sight 120A and rear foldable sight 120B is in a closed (or down) position. In FIG. 2, each of front foldable sight 120A and rear foldable sight 120B is in an open (or up) position.

Figure 3:
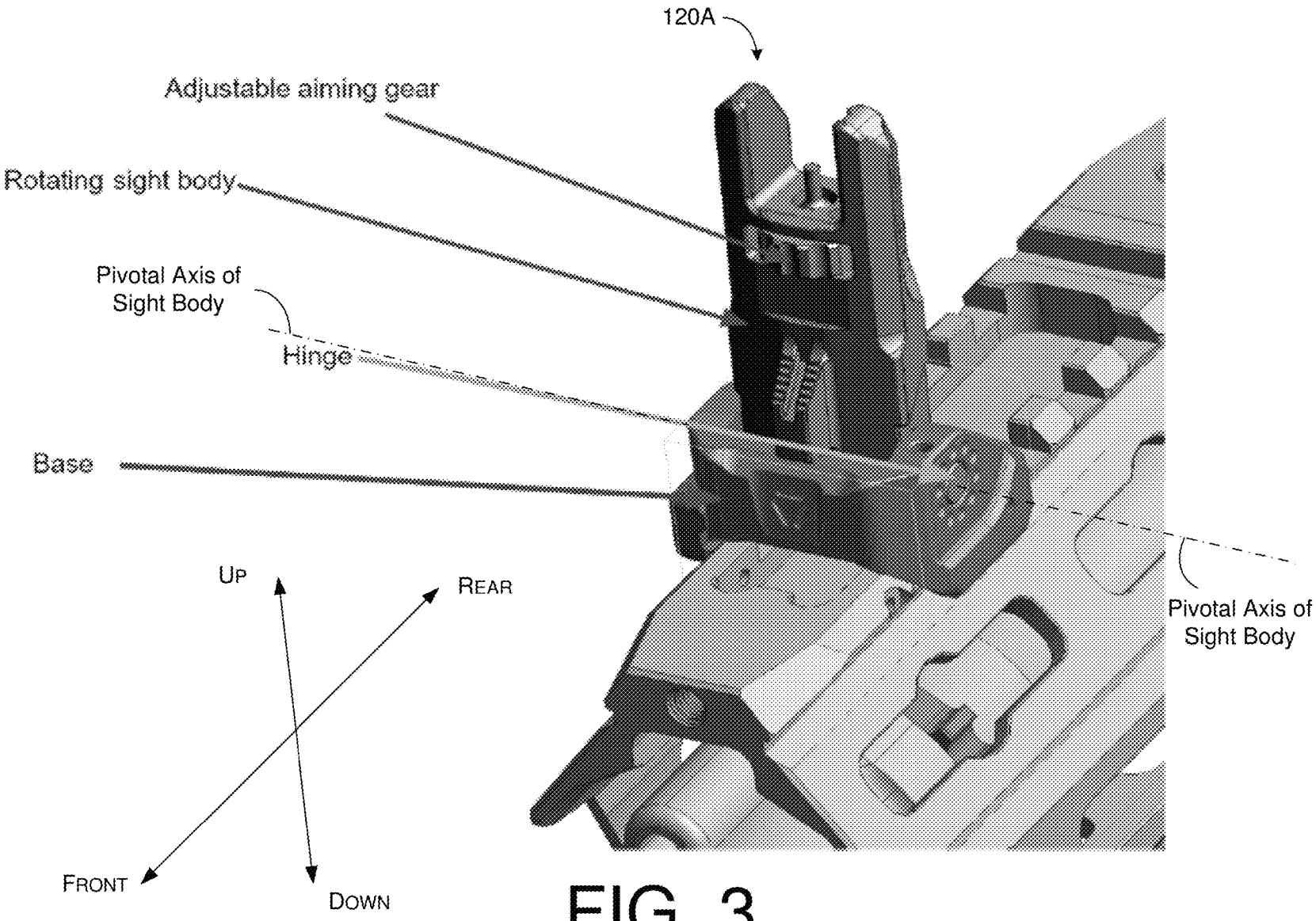
FIG. 3 is a diagram of an example implementation under a proposed scheme in accordance with the present disclosure.

FIG. 3 illustrates an example implementation of a foldable sight under a proposed scheme in accordance with the present disclosure. In the example shown in FIG. 3, the foldable sight (e.g., front foldable sight 120A or rear foldable sight 120B) may include a base, a hinge and a sight body. The base may be configured to be mounted on a portion of the firearm (e.g., a slide of a slide assembly of a semiautomatic pistol or a Picatinny rail, Weaver rail or dovetail mount of an AR-style or AK-style rifle, carbine, pistol or shotgun). The sight body may be pivotably attached to the base by the hinge and may contain a position holding device therein. For instance, the sight body may be configured with a hollow in which the position holding device is contained. The position holding device may be configured to hold the sight body at either a first position (e.g., closed position) or a second position (e.g., open position) responsive to the sight body being rotated from one of the first and second positions to another of the first and second positions (e.g., from the closed position to the open position or from the open position to the closed position).

As shown in FIG. 3, optionally, the foldable sight may also include an adjustable aiming gear. The adjustable aiming gear may be configured to move an aim point of a user when operating firearm 110. For instance, a knob of the adjustable aiming gear may be turned by the user to move an aimpoint on front foldable sight 120A or rear foldable sight 120B up or down (or left or right). In some implementations, the sight body may have a first distal end and a second distal end opposite the first distal end. More specifically, the first distal end of the sight body may be pivotably attached to the base, and the adjustable aiming gear may be disposed on or near the second distal end of the sight body.

Figure 4:
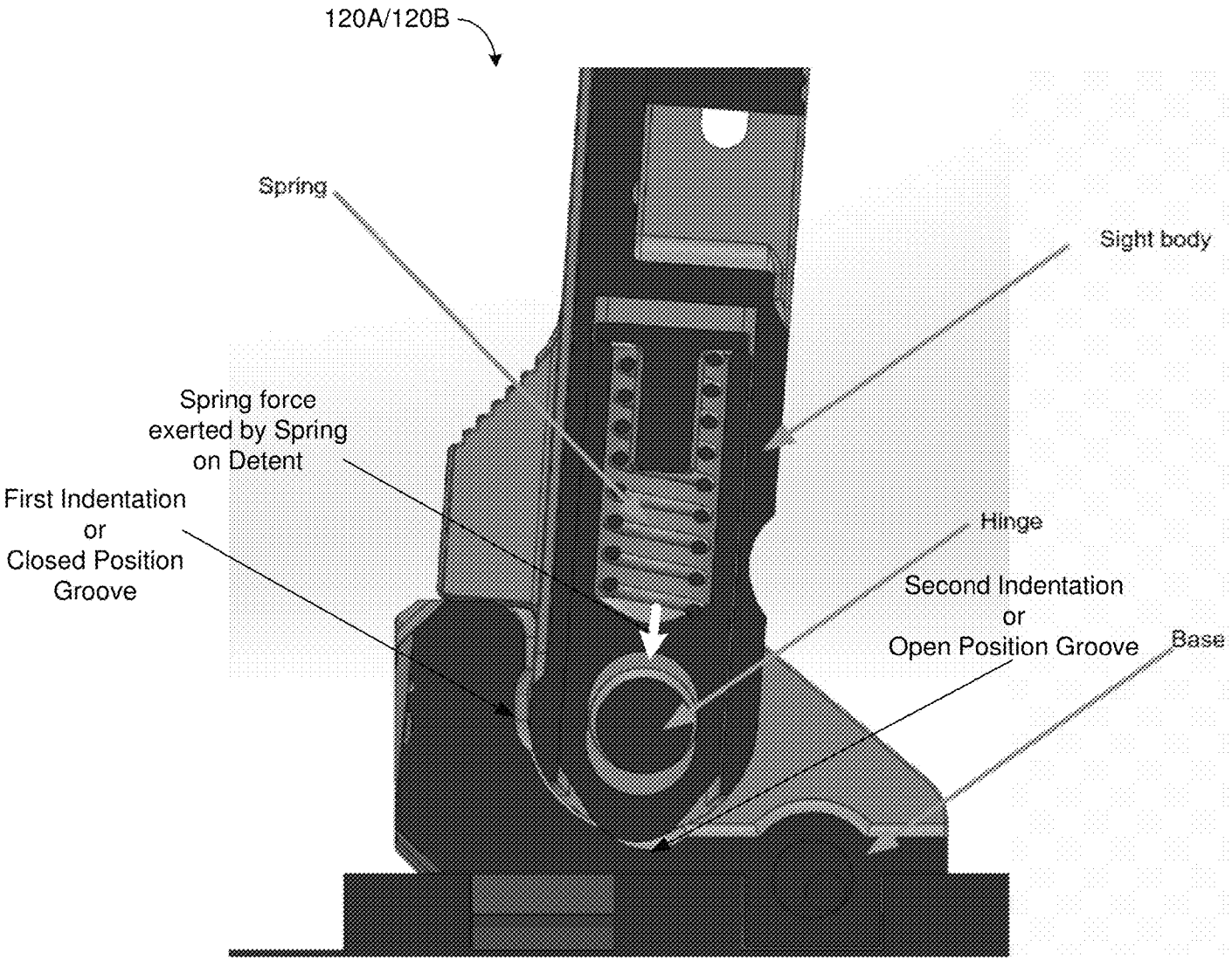
FIG. 4 is a diagram of an example implementation under a proposed scheme in accordance with the present disclosure.
Figure 5:
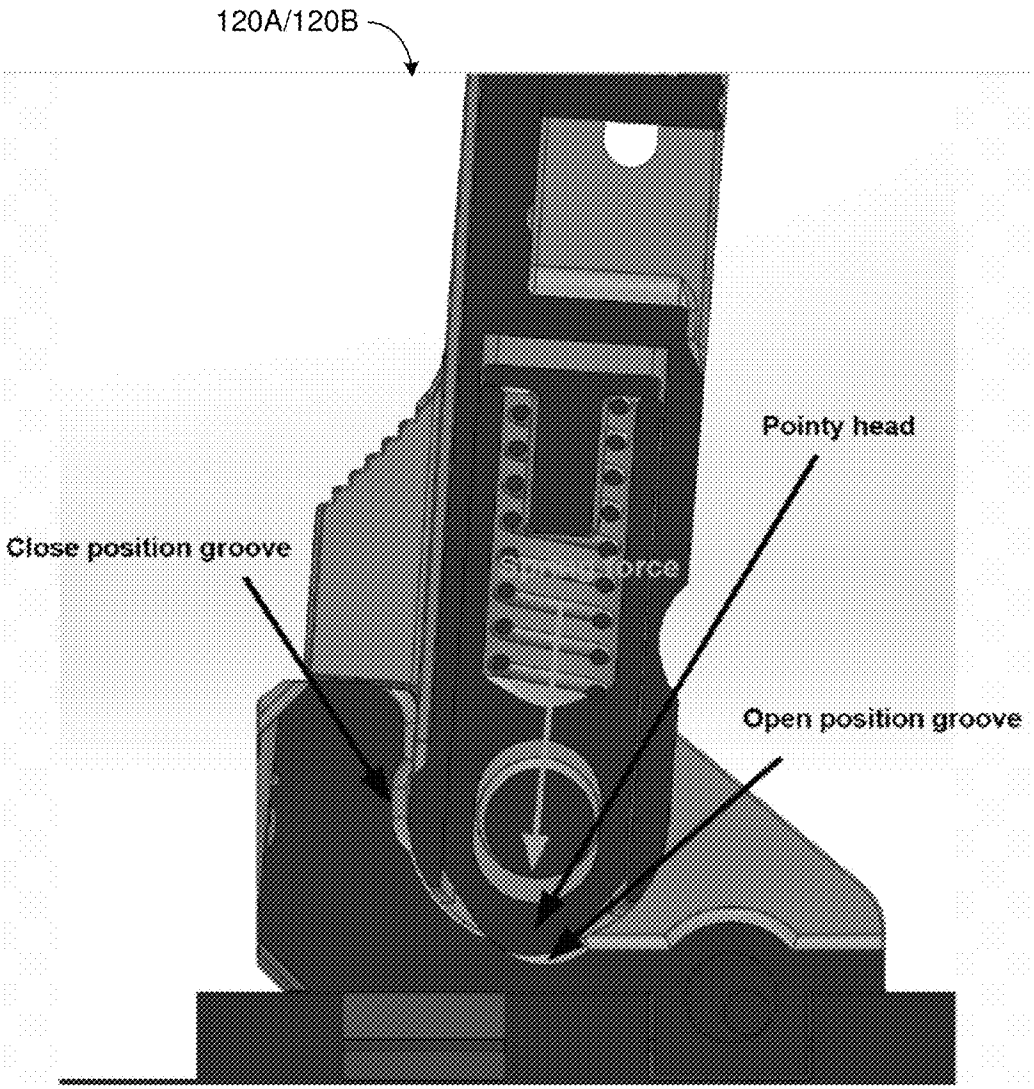
FIG. 5 is a diagram of an example implementation under a proposed scheme in accordance with the present disclosure.

Each of FIG. 4 and FIG. 5 illustrates an example implementation of a foldable sight (e.g., front foldable sight 120A or rear foldable sight 120B) under a proposed scheme in accordance with the present disclosure. Referring to each of FIG. 4 and FIG. 5, which shows a cross-sectional view of front foldable sight 120A or rear foldable sight 120B (along a pivotal axis of sight body), the position holding device may include a detent (e.g., a pin or ball or a piece) and an elastic element (e.g., a spring). The detent may be movable between a retracted position and a non-retracted position inside the hollow of the sight body. The elastic element may be configured to exert an elastic force on the detent to cause the detent to move from the retracted position toward the non-retracted position. As shown in FIG. 3, the detent may be movable between its retracted position and non-retracted position in a direction perpendicular to the pivotal axis around which the sight body is rotatable between the first position and the second position. For instance, in operation, the detent may move either toward the pivotal axis of the sight body or away from the pivotal axis of the sight body.

In some implementations, the base may be configured with a first indentation (herein interchangeably referred to as a "closed position groove") and a second indentation (herein interchangeably referred to as an "open position groove"). In such cases, when the sight body is in the first (closed or down) position, the detent may be in the non-retracted position with a portion of the detent received in the first indentation (or closed position groove) due to the force exerted by the elastic element, thereby holding the sight body in the first position. Additionally, when the sight body is in the second (open or up) position, the detent may be in the non-retracted position with the portion of the detent received in the second indentation (or open position groove) due to the force exerted by the elastic element, thereby holding the sight body in the second position. Moreover, when the sight body is between the first position and the second position, the detent may be in the retracted position, thereby allowing the sight body to rotate between the first position and the second position.

Highlight of Select Features

In view of the above, select features of various implementations in accordance with the present disclosure are highlighted below.

In one aspect, a foldable sight implementable on a plurality of firearms (e.g., AR-style or AK-style rifles, carbines, pistols or shotguns) may include a base, a hinge and a sight body. The base may be configured to be mounted on a portion of the firearm. The sight body may be pivotably attached to the base by the hinge and may contain a position holding device therein. The position holding device may be configured to hold the sight body at either a first position or a second position responsive to the sight body being rotated from one of the first and second positions to another of the first and second positions.

In some implementations, the sight body may be configured with a hollow in which the position holding device is contained. Moreover, the position holding device may include a detent and an elastic element. The detent may be movable between a retracted position and a non-retracted position inside the hollow of the sight body. The elastic element may be configured to exert an elastic force on the detent to cause the detent to move from the retracted position toward the non-retracted position.

In some implementations, the base may be configured with a first indentation and a second indentation. In such cases, when the sight body is in the first position, the detent may be in the non-retracted position with a portion of the detent received in the first indentation, thereby holding the sight body in the first position. Additionally, when the sight body is in the second position, the detent may be in the non-retracted position with the portion of the detent received in the second indentation, thereby holding the sight body in the second position. Moreover, when the sight body is between the first position and the second position, the detent may be in the retracted position, thereby allowing the sight body to rotate between the first position and the second position.

In some implementations, the detent may be movable between the retracted position and the non-retracted position in a direction perpendicular to a pivotal axis around which the sight body is rotatable between the first position and the second position.

In some implementations, the elastic element may include a spring.

In some implementations, the detent may include a pin or a ball.

In some implementations, the base may be configured to be mounted on a Picatinny rail, Weaver rail or dovetail mount of the firearm. In such cases, the firearm may include an AR-style or AK-style rifle, carbine, pistol or shotgun.

In some implementations, the base may be configured to be mounted on a slide of the firearm. In such cases, the firearm may include a pistol with a slide assembling comprising the slide.

In some implementations, the foldable sight may also include an adjustable aiming gear configured to move an aim point of a user when operating the firearm. In some implementations, the sight body may have a first distal end and a second distal end opposite the first distal end. Moreover, the first distal end of the sight body may be pivotably attached to the base, and the adjustable aiming gear may be disposed on or near the second distal end of the sight body.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A foldable sight implementable on a firearm, comprising:

a base configured to be mounted on a portion of the firearm;

a hinge; and a sight body pivotably attached to the base by the hinge and containing a position holding device therein, wherein the position holding device is configured to hold the sight body at either a first position or a second position responsive to the sight body being rotated from one of the first and second positions to another of the first and second positions, wherein the sight body is configured with a hollow in which the position holding device is contained, and wherein the position holding device comprises:

a detent movable between a retracted position and a non-retracted position inside the hollow of the sight body; and an elastic element configured to exert an elastic force on the detent to cause the detent to move from the retracted position toward the non-retracted position, and wherein the detent is movable between the retracted position and the non-retracted position in a direction perpendicular to a pivotal axis around which the sight body is rotatable between the first position and the second position.

2. The foldable sight of claim 1, wherein the base is configured with a first indentation and a second indentation, and wherein:

when the sight body is in the first position, the detent is in the non-retracted position with a portion of the detent received in the first indentation, thereby holding the sight body in the first position, when the sight body is in the second position, the detent is in the non-retracted position with the portion of the detent received in the second indentation, thereby holding the sight body in the second position, and when the sight body is between the first position and the second position, the detent is in the retracted position, thereby allowing the sight body to rotate between the first position and the second position.

3. The foldable sight of claim 1, wherein the elastic element comprises a spring.

4. The foldable sight of claim 1, wherein the detent comprises a pin or a ball.

5. The foldable sight of claim 1, wherein the base is configured to be mounted on a Picatinny rail, Weaver rail or dovetail mount of the firearm, and wherein the firearm comprises an AR-style or AK-style rifle, carbine, pistol or shotgun.

6. The foldable sight of claim 1, wherein the base is configured to be mounted on a slide of the firearm, and wherein the firearm comprises a pistol with a slide assembling comprising the slide.

7. The foldable sight of claim 1, further comprising:

an adjustable aiming gear configured to move an aim point of a user when operating the firearm.

8. The foldable sight of claim 7, wherein the sight body has a first distal end and a second distal end opposite the first distal end, wherein the first distal end of the sight body is pivotably attached to the base, and wherein the adjustable aiming gear is disposed on or near the second distal end of the sight body.

* * * * *